US009770628B2

(12) United States Patent
Shiue

(10) Patent No.: US 9,770,628 B2
(45) Date of Patent: Sep. 26, 2017

(54) WATERPROOF GOGGLE

(71) Applicant: QBAS CO., LTD., Taipei (TW)

(72) Inventor: Chih-Cheng Shiue, Taipei (TW)

(73) Assignee: QBAS CO., LTD., Taipei (TW)

( * ) Notice: Subject to any disclaimer, the term of this patent is extended or adjusted under 35 U.S.C. 154(b) by 29 days.

(21) Appl. No.: 14/990,491

(22) Filed: Jan. 7, 2016

(65) Prior Publication Data

US 2017/0197117 A1 Jul. 13, 2017

(51) Int. Cl.
*A63B 33/00* (2006.01)

(52) U.S. Cl.
CPC ..... *A63B 33/002* (2013.01); *A63B 2033/004* (2013.01)

(58) Field of Classification Search
CPC ..... A63B 33/002
USPC ..... 2/442, 440, 428
See application file for complete search history.

(56) References Cited

U.S. PATENT DOCUMENTS 6,530,093 B1 * 3/2003 Chiang ..... A63B 33/002 2/428
2006/0059607 A1 * 3/2006 Chiang ..... A63B 33/002 2/428
2008/0111966 A1 * 5/2008 Chiang ..... A63B 33/002 351/43

FOREIGN PATENT DOCUMENTS

JP 201245361 A * 3/2012 ..... A63B 33/022
JP WO 2013069585 A1 * 5/2013 ..... A63B 33/002
TW EP 1118357 A1 * 7/2001 ..... A63B 33/002
TW EP 2423099 A2 * 2/2012 ..... A63B 33/002

* cited by examiner

*Primary Examiner* — Tejash Patel
(74) *Attorney, Agent, or Firm* — Masuvalley & Partners

(57) ABSTRACT

A waterproof goggle is provided and includes a frame structure, a lens set and a waterproof leaning structure. The lens set is disposed in the frame structure and the waterproof leaning structure is waterproofly connected to the frame structure. The waterproof leaning structure includes an outer surface, an inner surface, several protrusions and several recesses; the outer surface is opposite to the inner surface, and the protrusions and recesses are alternately disposed on the outer surface; the protrusions are curvedly extended along a longitudinal direction from a front edge to a rear edge of the outer surface, and widths of each of the protrusions are varied along the longitudinal direction. Therefore, the leaning structure can be more easily stretched to fit different users' faces.

6 Claims, 5 Drawing Sheets

WATERPROOF GOGGLE

BACKGROUND OF THE INVENTION

Field of the Invention

The present invention provides a goggle, which particularly pertains to a waterproof goggle.

Descriptions of the Related Art

Waterproof goggles are used during waterborne or underwater activities (ex. swimming, diving or snorkeling) to prevent water or dust from getting into direct contact with the eyes. To provide a comfortable wearing of the waterproof goggle, as well as a good waterproof effect, the waterproof goggle should fit the wearer's facial shape/sizes well. If it not, the water or dust will easily flow inside the waterproof goggle through the interval between the wearer's face and the goggle, thereby causing the wearer uncomfortable or hurt.

However, there are too many different facial shapes/sizes, varying from elongated faces to flat faces and from wide faces to narrow faces, so it is practically impossible for the manufacturer to make waterproof goggles fitting every facial shapes/sizes because of the high costs.

Accordingly, there is a need in the art to provide a waterproof goggle which can be worn by users' with different facial shapes/sizes, while decreasing manufacturing costs.

SUMMARY OF THE INVENTION

To solve the aforesaid problems, an objective of the present invention is to provide a waterproof goggle that can fit the wearer's face of different shapes or sizes.

The waterproof goggle comprises: a frame structure, comprising two rings and a bridge which is connected to the two rings; a lens set, comprising two lenses disposed in the two rings respectively; and a waterproof leaning structure, being waterproofly connected to the rings of the frame structure, and comprising an outer surface, an inner surface, a plurality of protrusions and a plurality of recesses, wherein the outer surface is opposite to the inner surface, and the protrusions and the recesses are alternately disposed on the outer surface, so one of the recesses locates between two of the protrusions; wherein the protrusions are curvedly extended along a longitudinal direction from a front edge to a rear edge of the outer surface, and widths of the protrusions are varied along the longitudinal direction.

By having curved protrusions of varied widths disposed on the outer surface of the leaning structure of the waterproof goggle, the leaning structure can be more easily stretched to fit different facial shapes/sizes. Therefore, the waterproof goggle of the present invention is suitable for use with the facial shapes/sizes of different wearer to reduce the additional cost associated with the different waterproof goggles.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

In the following description, the present invention will be explained with reference to embodiments thereof. However, the description of these embodiments is only for the purpose of illustration rather than limitation. It should be appreciated that in the following embodiments and attached drawings, elements not directly related to the present invention are omitted from depiction; and the sizes of and dimensional relationships among individual elements in the attached drawings are illustrated only for the ease of understanding but not to limit the actual sizes.

Figure 1:
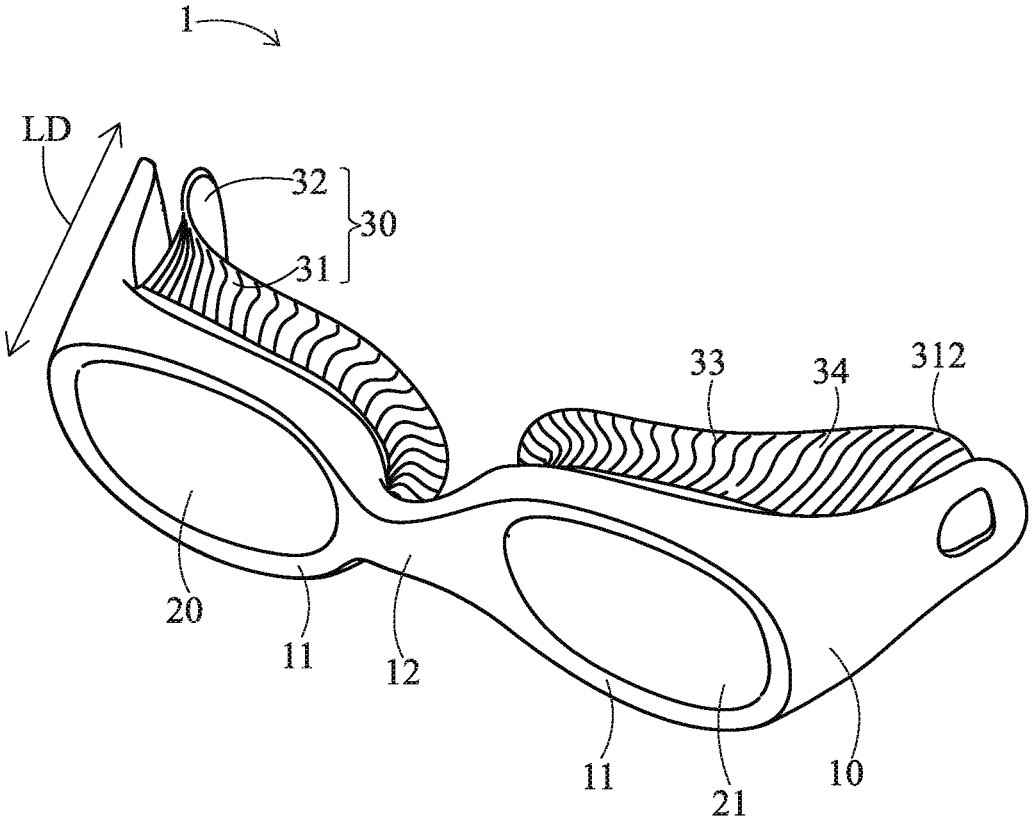
FIG. 1 is a perspective view of a waterproof goggle according to the first embodiment of the present invention.

The first embodiment according to the present invention is a waterproof goggle. FIG. 1 illustrates a perspective view of a waterproof goggle 1. The waterproof goggle 1 comprises a frame structure 10, a lens set 20 and a waterproof leaning structure 30.

The frame structure 10 comprises two rings 11 and a bridge 12 which is connected to the two rings 11; i.e. the two opposite ends of the bridge 12 are connected to the two rings 11 respectively. The rings 11 and the bridge 12 can be formed in one-piece.

The lens set 20 comprises two lenses 21 which are disposed in two rings 11 respectively. The lens 21 can be tightly surrounded and holed by the ring 11 to make the connection between the lens 21 and the ring 11 waterproof.

Figure 2:
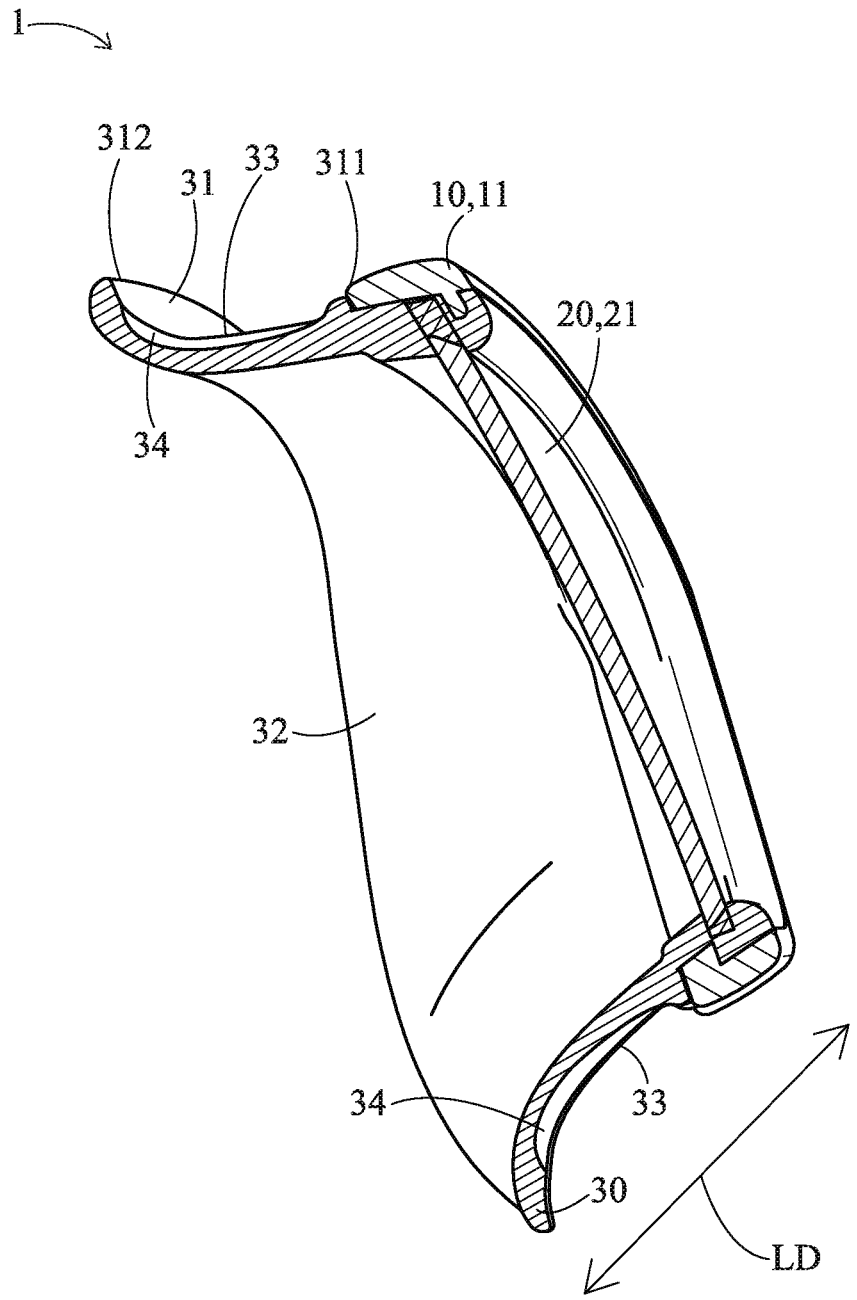
FIG. 2 is a sectional view of the waterproof goggle shown in FIG. 1.

Please refer to FIG. 2 along with FIG. 1, the leaning structure 30 is waterproofly connected to the rings 11 of the frame structure 20. The leaning structures 30 may be two separate portions to connect to the two rings 11 respectively; optionally, the leaning structures 30 may also has a nose portion (not shown) between the two rings 21 to cover the user's nose.

The leaning structure 30 is waterproofly connected the rings 11, so no interval for water passing through is formed between the leaning structure 30 and the rings 11. The leaning structure 30 can cover (i.e. encapsulate) the inner of the rings 11 to achieve the waterproof connection. The leaning structure 30 can also cover the periphery of the lens 21 to render the connection between the lens 21 and the ring 11 waterproof. Therefore, when the user wear the waterproof goggle 1 during the waterborne or underwater activity, water or dust hardly passes through the connection between the lenses 21, the ring 11 and the leaning structure 30.

The waterproof leaning structure 30 is made of a flexible material, which has a Shore hardness between A10 and A95. The flexible material can be any of the following: thermoplastic rubber (TPR), thermoplastic polyurethane (TPU), thermoplastic elastomer (TPE), polyvinyl chloride (PVC), silicone rubber, rubber or a combination thereof however, other materials may also be used by those of ordinary skill in the art as a replacement, and there is no limitation thereon.

The leaning structure 30 comprises an outer surface 31 and an inner surface 32 which is opposite to the outer surface 31; when worn by the user, the inner surface 32 can touch user's face while the outer surface 31 does not. The inner surface 32 can be a smooth surface to provide a comfort wearing to the user.

The leaning structure 30 further comprises a plurality of protrusions 33 and a plurality of recesses 34; the protrusions 33 and the recesses 34 are alternately disposed on the outer surface 31, so one of the recesses 34 locates between two of the protrusions 33. That is, the protrusions 33 are protruded from the outer surface 31, and the recesses 34 are formed accordingly. The protrusions 33 and the outer surface 31 are formed in one-piece.

Figure 3:
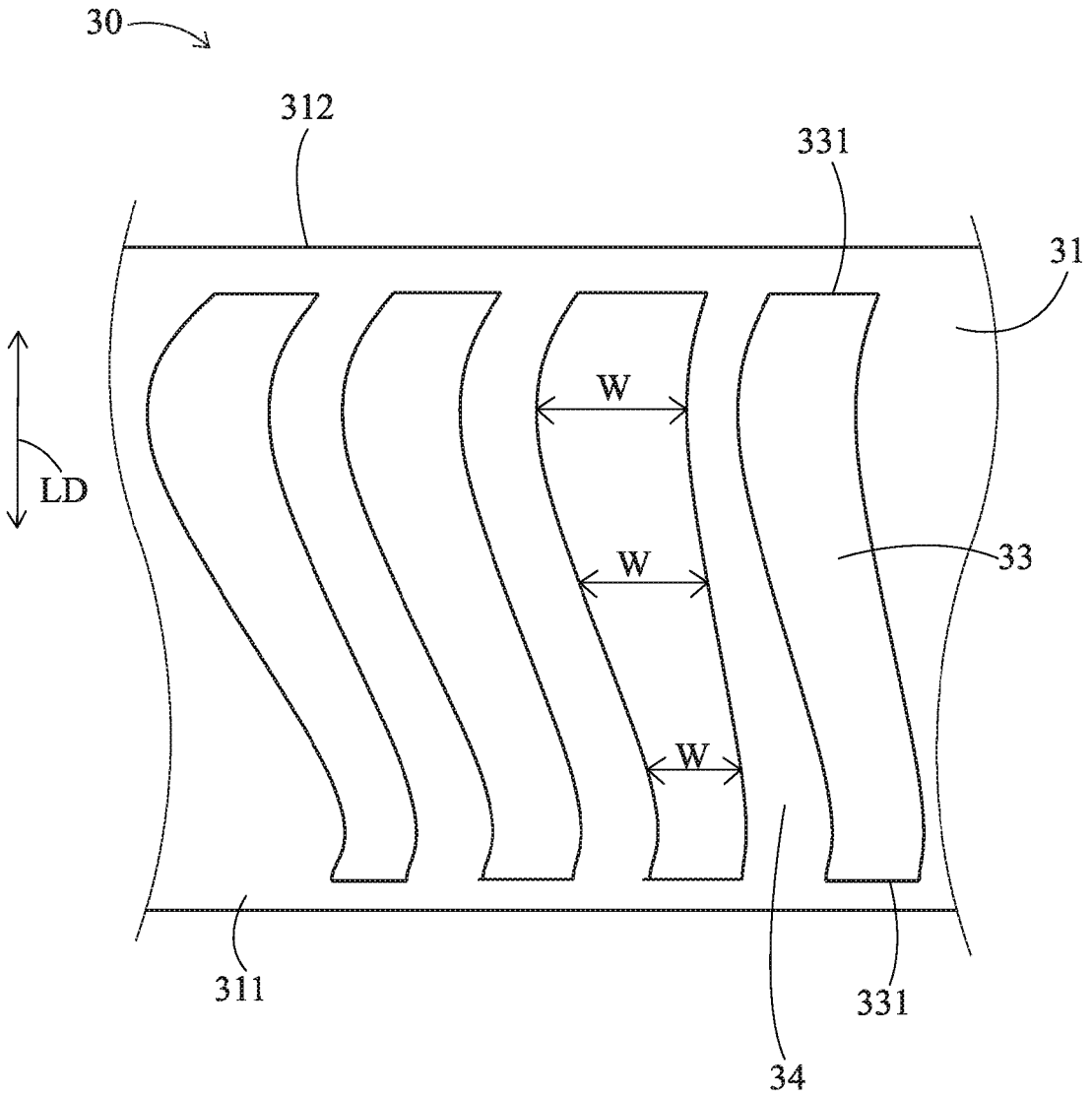
FIG. 3 is a plane schematic view of parts of the waterproof leaning structure of the waterproof goggle shown in FIG. 1.

Please refer to FIG. 3 along with FIG. 1, the protrusions 33 are curvedly extended along a longitudinal direction LD from a front edge 311 to a rear edge 312 of the outer surface 31. The front edge 311 of the outer surface 31 is the edge connecting/adjacent to the rings 11 and the rear edge 312 is remote from the front edge 311 and adjacent to the user's face. The longitudinal direction LD is defined from the front edge 311 to the rear edge 312, so the longitudinal direction LD is a front-rear direction when user wearing the waterproof goggle 1 faces forward.

Each of the protrusions 33 extended along the longitudinal direction LD has two ends 331 which are separate from each other in the longitudinal direction LD. Besides, the two ends 331 can be right in the front edge 311 and the rear edge 312 of the outer surface 31 respectively (as shown in FIG. 1); namely, the protrusion 33 is extended right from the front edge 311 to the rear edge 312. The two ends 331 can also be spaced apart from the front edge 311 and the rear edge 312 respectively (as shown in FIG. 2, FIG. 3 or FIG. 4).

Furthermore, each of the protrusions 33 is curvedly extended, so between the two ends 331 the extension/edge line of the protrusion 33 is a curve line. The curvature of the edge line of each of the protrusions 33 can be different according to the positions of the protrusions 33. Moreover, widths W of each of the protrusions 33 are varied along the longitudinal direction LD, so the widths W of different portions of one protrusion 33 are different. Preferably, the widths W are varied between 1 mm and 6 mm.

By virtue of the curved protrusion 33 with varied widths W, the waterproof leaning structure 30 can have better flexibility; namely, the waterproof leaning structure 30 is more easily stretched/deformed in a direction crossing the longitudinal direction LD, and thus the waterproof leaning structure 30 can easily fit the different users' faces.

Figure 4:
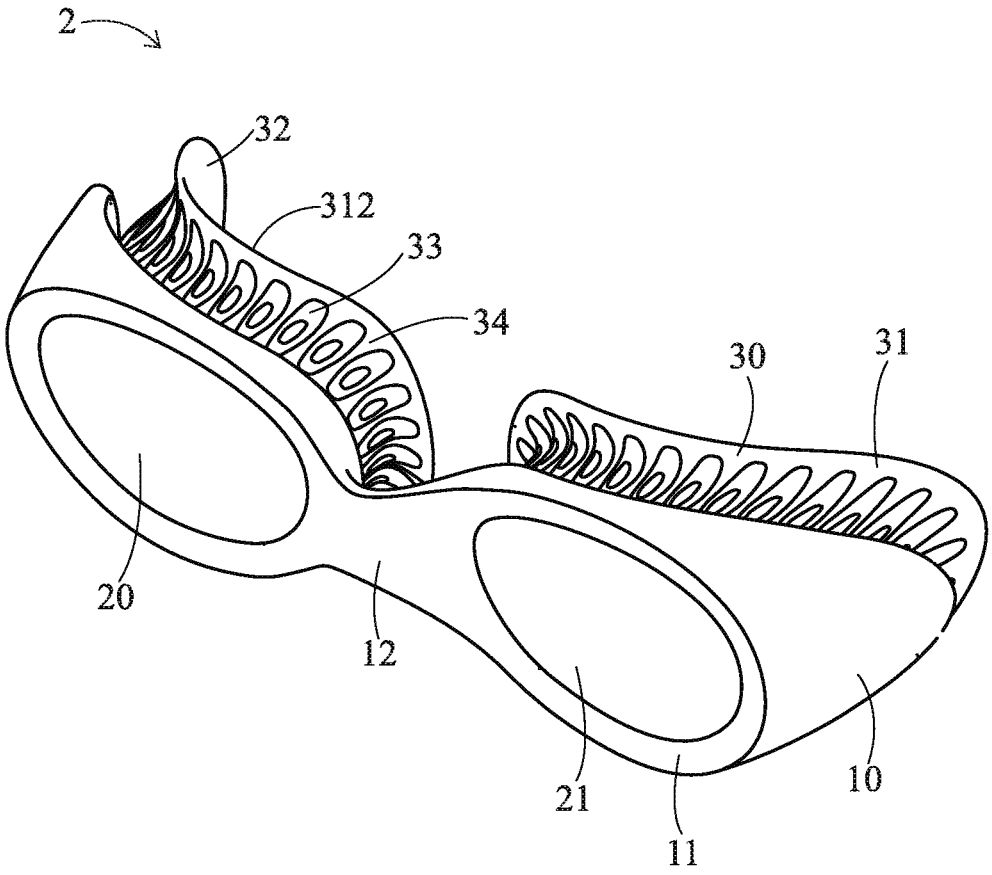
FIG. 4 is a perspective view of a waterproof goggle according to the second embodiment of the present invention.
Figure 5:
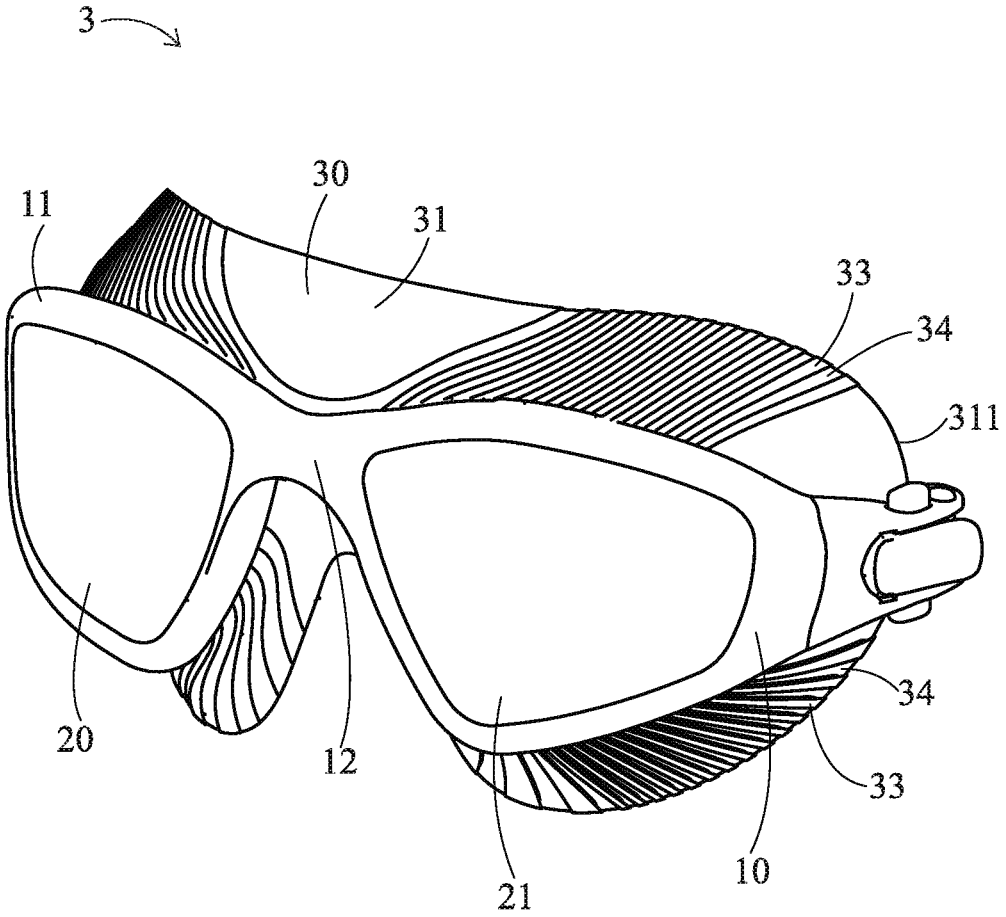
FIG. 5 is a perspective view of a waterproof goggle according to the third embodiment of the present invention.

FIG. 4 illustrates a perspective view of a waterproof goggle 2 according to the second embodiment of the present invention, and FIG. 5 illustrates a perspective view of a waterproof goggle 3 according to the third embodiment of the present invention. The waterproof goggles 2 and 3 have curved protrusions 33 with varied widths to improve the flexibility of the waterproof leaning structure 30; the curved protrusions 33 can just be disposed on parts of the outer surface 31 (as shown in FIG. 5) to improve the flexibility of the specific parts of the waterproof leaning structure 30.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A waterproof goggle, comprising:

a frame structure, comprising two rings and a bridge which is connected to the two rings;

a lens set, comprising two lenses disposed in the two rings respectively; and a leaning structure, being waterproofly connected to the two rings of the frame structure, and comprising an outer surface, an inner surface, a plurality of protrusions and a plurality of recesses, wherein the outer surface is opposite to the inner surface, and the plurality of protrusions and the plurality of recesses are alternately disposed on the outer surface, so that one of the plurality of recesses locates between two of the plurality of protrusions;

wherein the plurality of protrusions are curvedly extended along a longitudinal direction from a front edge to a rear edge of the outer surface, and a width of each of said plurality of protrusions varies along the longitudinal direction.

2. The waterproof goggle as claimed in claim 1, wherein the width of each of the plurality of protrusions varies between about 1 mm and 6 mm.

3. The waterproof goggle as claimed in claim 1, wherein each of the plurality of protrusions comprises two ends which are spaced apart from the front edge and the rear edge of the outer surface respectively.

4. The waterproof goggle as claimed in claim 1, wherein the inner surface is smooth.

5. The waterproof goggle as claimed in claim 1, wherein a Shore hardness of a material of the leaning structure is between A10 to A95.

6. The waterproof goggle as claimed in claim 5, wherein the material is a flexible material including Thermoplastic Rubber (TPR), Thermoplastic Polyurethane (TPU), Thermoplastic Elastomer (TPE), Polyvinyl Chloride (PVC), silicone rubber, Rubber and the combination thereof.

* * * * *